US008750549B2

(12) United States Patent
Lorenz

(10) Patent No.: US 8,750,549 B2
(45) **Date of Patent: *Jun. 10, 2014**

(54) RESONATOR SYSTEM FOR A SPEAKER OF AN ELECTRONIC DEVICE

(71) Applicant: Research in Motion Limited, Waterloo (CA)

(72) Inventor: Christian Lorenz, Waterloo (CA)

(73) Assignee: Blackberry Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/654,012

(22) Filed: Oct. 17, 2012

(65) Prior Publication Data

US 2013/0094688 A1 Apr. 18, 2013

Related U.S. Application Data

(63) Continuation of application No. 12/574,375, filed on Oct. 6, 2009, now Pat. No. 8,320,599.

(60) Provisional application No. 61/103,356, filed on Oct. 7, 2008.

(51) Int. Cl.
*H04R 1/20* (2006.01)
*H04R 1/28* (2006.01)

(52) U.S. Cl.
CPC ..... *H04R 1/2819* (2013.01); *H04R 1/2807* (2013.01)
USPC ..... 381/353; 381/345; 381/349

(58) Field of Classification Search
CPC ..... H04R 1/2807; H04R 1/2819; H04R 1/02; H04R 1/20; H04R 1/28
USPC ..... 381/337, 345, 349–353, 340–342; 181/160, 182, 198, 199
See application file for complete search history.

(56) References Cited

U.S. PATENT DOCUMENTS

2005/0265574 A1 12/2005 Holmes et al.
2009/0274336 A1 11/2009 Infanti

FOREIGN PATENT DOCUMENTS

CA 2488779 A1 6/2005
EP 2114084 A1 11/2009
WO WO 97/47117 12/1997
WO WO 2007/000484 A1 1/2007
WO WO 2008/033579 A2 3/2008

*Primary Examiner* — Tuan D Nguyen
(74) *Attorney, Agent, or Firm* — McCarthy Tètrault LLP

(57) ABSTRACT

A system providing a resonator for a transducer of an electronic device is provided. The system comprises a housing defining: a first enclosure having a first opening to house a back end of the transducer and a second opening; a port connected to the first enclosure through the second opening of the first enclosure, the port having a first end, a second end, an interior channel and a second opening in the second end; a second enclosure to cover a front portion of the speaker; and at least one aperture defined in the second enclosure to allow air outside of the electronic device to be in communication with the front of the transducer. When the transducer is mounted into the first enclosure, a first volume between the transducer and the first enclosure is formed which is in communication with air surrounding the second end of the port.

19 Claims, 19 Drawing Sheets

Block diagram 1300

RESONATOR SYSTEM FOR A SPEAKER OF AN ELECTRONIC DEVICE

RELATED APPLICATIONS

This application is a continuation application of U.S. patent application Ser. No. 12/574,375 filed on Oct. 6, 2009, which claims priority from U.S. Provisional Patent Application Ser. No. 61/103,356 filed Oct. 7, 2008.

FIELD OF DISCLOSURE

The disclosure herein describes a resonator for a transducer of an electronic device. In particular, the disclosure includes one or more enclosures for a speaker that act as resonator(s) to modify acoustic characteristics of the speaker.

BACKGROUND

Current wireless handheld mobile communication devices perform a variety of functions to enable mobile users to stay current with information. A speaker is an acoustic transducer which is commonly provided with a device as an audio output device. Within the housing of an electronic device, especially in a portable device, there may be constraints as to operating characteristics of the speaker.

BRIEF DESCRIPTION OF THE DRAWINGS

Details on the disclosure will now be described, by way of example only, with reference to the accompanying drawings, in which.

DETAILED DESCRIPTION OF AN EMBODIMENT

Figure 1:
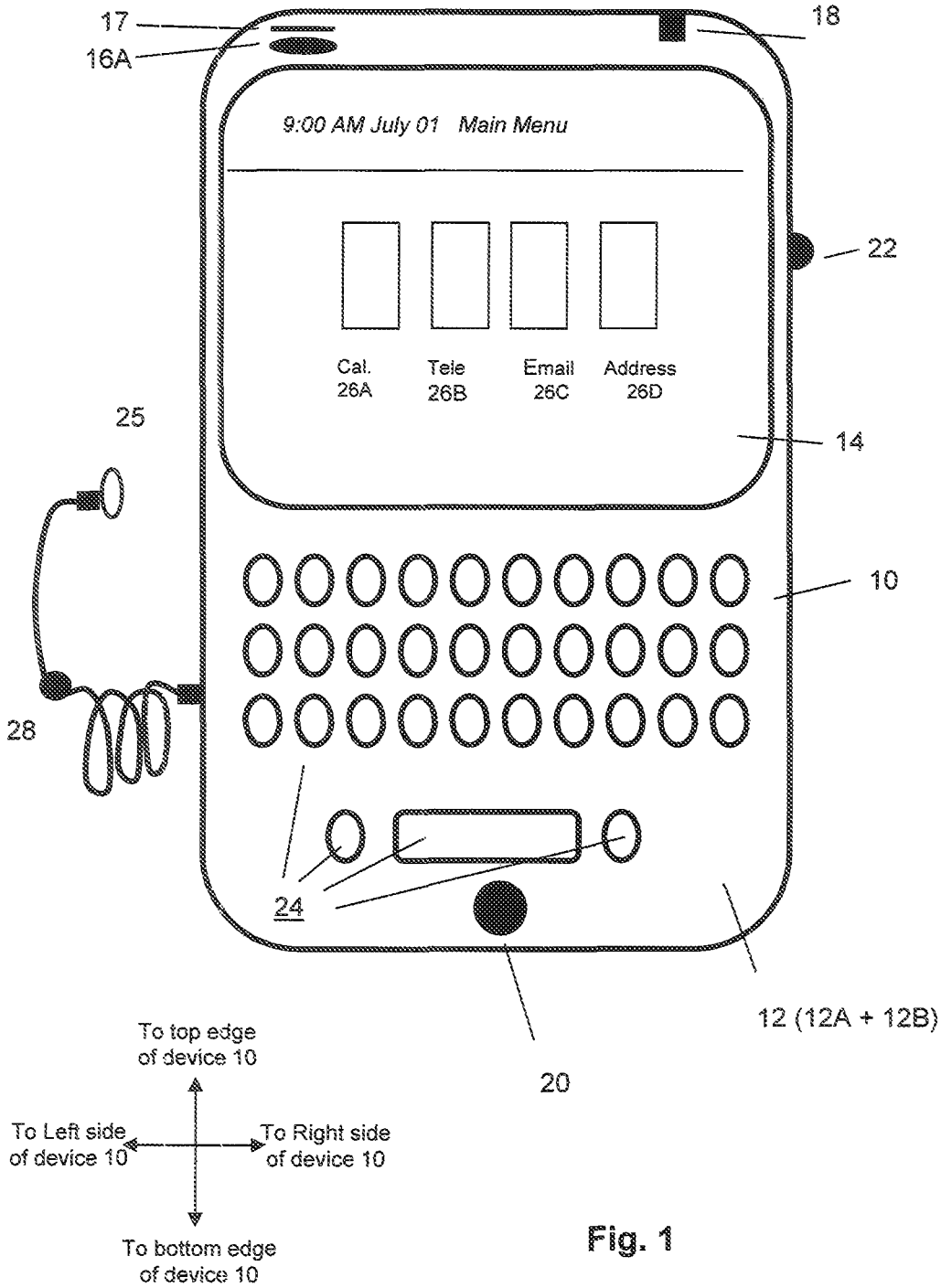
FIG. 1 is a front plan view of an electronic device with its housing having an internal front speaker and a related enclosure system in accordance with an embodiment.

The description which follows and the embodiments described therein are provided by way of illustration of an example or examples of particular embodiments of the principles of the present disclosure. These examples are provided for the purposes of explanation and not limitation of those principles and of the disclosure. In the description which follows, like parts are marked throughout the specification and the drawings with the same respective reference numerals.

A feature of an embodiment provides acoustic tuning for transducers in electronic devices. A brief description of some notable general aspects of embodiments is first provided. Then, some general functional elements of a device incorporating an embodiment are provided, followed by more details on notable features of an embodiment.

Turning to notable aspects of an embodiment, in a first aspect, a system providing a resonator for a transducer of an electronic device is provided. The system comprises a housing defining: a first enclosure having a first opening to house a back end of the transducer and a second opening; a port connected to the first enclosure through the second opening of the first enclosure, the port having a first end, a second end, an interior channel and a second opening in the second end; a second enclosure to cover a front portion of the speaker; and at least one aperture defined in the second enclosure to allow air outside of the electronic device to be in communication with the front of the transducer. In the system, when the transducer is mounted into the first enclosure, a first volume between the transducer and the first enclosure is formed which is in communication with air surrounding the second end of the port through the interior channel of the port.

In the system, the housing may further comprise: an exterior wall; and an interior ledge connected to the exterior wall and defining the first opening, a top of the first enclosure and a bottom of the second enclosure.

The system may further comprise a cover for the electronic device to cover walls of the second enclosure, the port and the first enclosure, the cover having a second port mating with the port.

In the system, the cover may cover a portion of the exterior wall and a top of the second enclosure.

In the system, the cover may further comprise a third opening in a top surface of the cover to allow the air outside of the electronic device to be in communication with the front of the transducer.

In the system, the housing may further comprise a plurality of vertical walls defining parts of the first enclosure and second enclosure.

In the system, the housing may further comprise: a cap located on top of the plurality of vertical walls defining parts of second enclosure; and an aperture in the cap to allow the air outside of the electronic device to be in communication with the front of the transducer.

The system may further comprise a printed circuit board for the electronic device providing a mounting location for the transducer and forming a bottom of the first enclosure.

The system may further comprise a gasket located between the printed circuit board and a bottom edge of the first enclosure.

In the system, the transducer may be a speaker.

In the system, the first enclosure may be rectangular in shape.

In the system, the first enclosure may have exterior dimensions of approximately 13 mm by 15 mm by 4 mm.

In the system, the first enclosure may have dimensions to provide the first volume to be approximately 0.2 $cm^3$ or less.

In the system, the resonator may equalize a frequency response of the transducer to be in a frequency range of between about 2 kHz and 3.5 kHz.

In the system, the port may have a length of between approximately 1 mm and 10 mm.

In the system, the port may have an area of between approximately 0.5 and 8 $mm^2$.

In the system, the second enclosure may be rectangular in shape.

The system may further comprise acoustic mesh covering the second end of the port.

In the system, the housing may be plastic.

In another aspect, a resonator for a transducer of an electronic device is provided. The resonator comprises: a first enclosure having a first opening to receive a back end of the transducer and a second opening; and a port connected to the first enclosure through the second opening of the enclosure, the port having a first end, a second end, an interior channel spanning from the first end to the second end. When the transducer is mounted into the first enclosure, a first volume in the first enclosure between the transducer and the first enclosure (namely the interior sides of the first enclosure) is formed which is in communication with air surrounding the second end of the port through the interior channel of the port. The transducer and the resonator may be mounted on a printed circuit board of the electronic device.

The resonator may further comprise a second enclosure to cover a front portion of the transducer, the second enclosure including at least one aperture to allow air outside of the device to be in communication with the front of the transducer.

In the resonator, the second end of the port may connect with an opening in a housing of the device to be in communication with air surrounding the device.

In the resonator, the transducer may be a speaker.

In the resonator, the port may have a length of between approximately 1 mm and 10 mm and an opening in the second side of the port for the interior channel may have an area of between approximately 0.5 and 8 $mm^2$.

In the resonator, the first enclosure may have dimensions to provide the first volume to be approximately 0.2 $cm^3$ or less.

In the resonator, the first enclosure may be rectangular in shape.

In the resonator, the first enclosure may have exterior dimensions of approximately 13 mm by 15 mm by 4 mm.

The resonator may equalize a frequency response of the transducer to be in a frequency range of between about 2 kHz and 3.5 kHz.

In the resonator, the first enclosure may be plastic.

In the resonator, the second enclosure may rectangular in shape.

The resonator may further comprise acoustic mesh covering the second end of the port.

In the resonator, at least one of the first or second enclosures may be formed in part of a housing of the electronic device.

In yet another aspect, an acoustic system for an electronic device is provided. The system comprises: a speaker; a first enclosure having a first opening to receive a back end of the transducer and a second opening; a port connected to the first enclosure through the second opening of the enclosure, the port having a first end, a second end, an interior channel and a third opening in the second end; and a second enclosure to cover a front portion of the transducer. The second enclosure includes at least one aperture to air outside of the device to be in communication with the front of the transducer. When the transducer is mounted into the first enclosure, a first volume between the transducer and the first enclosure is formed which is in communication with air surrounding the second end of the port through the interior channel of the port. The transducer with the first and second enclosures may be mounted on a printed circuit board of the electronic device.

In the acoustic system, the second end of the port may be connectable with an opening in a housing of the device to be in communication with air surrounding the device.

In the acoustic system, the port may have a length of between approximately 1 mm and 10 mm and an opening in the second side of the port for the interior channel may have an area of between approximately 0.5 and 8 $mm^2$.

In the acoustic system, the first enclosure may be rectangular in shape.

In the acoustic system, the second enclosure may be rectangular in shape.

In the acoustic system, the first and second enclosures equalize a frequency response of the speaker to be in a frequency range of between about 2 kHz and 3.5 kHz.

In still another aspect, an acoustic system for an electronic device is provided. The system comprises: a housing for the device; a printed circuit board; a speaker; a first enclosure having a first opening to receive a back end of the speaker and a second opening; a port connected to the first enclosure through the second opening of the enclosure, the port having a first end, a second end, an interior channel and a third opening in the second end; and a second enclosure to cover a front portion of the speaker, the second enclosure including at least one aperture to air outside of the device to be in communication with the front of the speaker. When the speaker is mounted into the first enclosure, a first volume in the first enclosure between the transducer and the first enclosure is formed which is in communication with air surrounding the second end of the port through the interior channel of the port. The third opening of the port is connected with an opening in the housing to be in communication with air surrounding the device.

The speaker with the first and second enclosures may be mounted on the printed circuit board.

In the system, the first enclosure may be rectangular in shape.

In other aspects, various sets and subsets of the above noted aspects are provided.

Now some general functional elements of a device incorporating an embodiment are provided. Referring to FIG. 1, an electronic device for receiving electronic communications in accordance with an embodiment of the disclosure is indicated generally at 10. In the present embodiment, electronic device 10 is based on a computing platform having exemplary functionality of an enhanced personal digital assistant such as cellphone, e-mail, photographic and media playing features. It is, however, to be understood that electronic device 10 can be based on construction design and functionality of other electronic devices, such as smart telephones, desktop computers pagers or laptops having telephony equipment. In a present embodiment, electronic device 10 includes a housing 12 comprising front housing 12A and rear housing 12B (not shown). There may be one or more components in device 10, including, for example any of: a display 14, front speaker 16A (shown through opening 17 in front housing 12A), a light emitting diode (LED) indicator 18, a trackball 20, a trackwheel (not shown), an ESC ("escape") key 22, keys 24, touchpad (not shown), a telephone headset comprised of an ear bud 25 and a microphone 28. Display 14 may be a liquid crystal display (LCD) and may incorporate a touchscreen. Trackball 20 and ESC key 22 can be inwardly depressed as a means to provide additional input signals to device 10. Other components may also be provided in device 10. Apertures may be provided in housing 12 to allow access to components located inside device 10. As such, aperture 17 is provided to allow sound generated by speaker 16A to emanate out of device 10. Another aperture (not shown) is provided that provides an air connection for a back enclosure of speaker 16A (described below). Any embodiment may implement one or more of any of the above noted components therein. It may not be necessary to have any of the above noted components in an embodiment.

Housing 12 may be made from a plastic material, such as polycarbonate. Its components may be formed via an injection molding process. It may have coatings, such as metallicized paints or coatings provided to interior or exterior surfaces or regions. Housing 12 can be made from any suitable material (such as metal) as will occur to those of skill in the art and may be suitably formed to house and hold all components of device 10.

Device 10 is operable to conduct wireless telephone calls, using any known wireless phone system such as a Global System for Mobile Communications ("GSM") system, Code Division Multiple Access ("CDMA") system, Cellular Digital Packet Data ("CDPD") system and Time Division Multiple Access ("TDMA") system. Other wireless phone systems can include Bluetooth and the many forms of 802.11 wireless broadband, like 802.11a, 802.11b, 802.11g, etc. that support voice. Other embodiments include Voice over IP (VoIP) type streaming data communications that can simulate circuit switched phone calls. Output audio signals are produced on any of speakers 16A and/or 16B. Ear bud 25 can be used to listen to phone calls and other sound messages and microphone 28 can be used to speak into and input sound messages to device 10.

Various applications are provided on device 10, including email, telephone, calendar and address book applications. A graphical user interface (GUI) providing an interface to allow entries of commands to activate these applications is provided on display 14 through a series of icons 26. Shown are calendar icon 26A, telephone icon 26B, email icon 26C and address book icon 26D. Such applications can be selected and activated using the touchpad and/or the trackball 20. Further detail on selected applications is provided below.

Keys 24 provide one or more distinct, fixed input keys for device 10. Typically, they may include at least part of keys in an alphanumeric character set. A touchpad may be provided and configured to provide an additional set of "keys" (or input areas) to augment keys 24. Keys may also be incorporated into part of a touchscreen on device 10.

Figure 2:
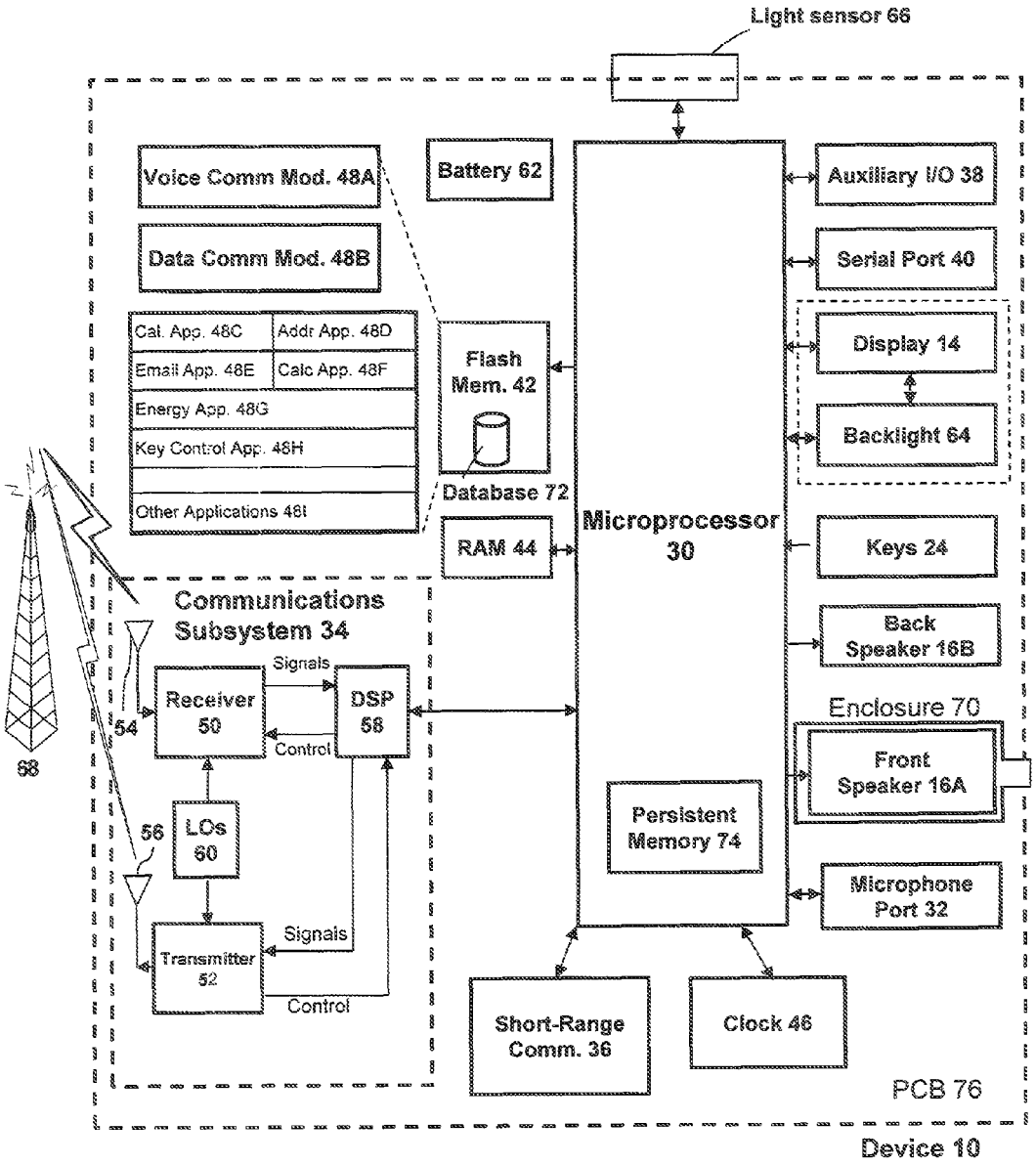
FIG. 2 is a block diagram of internal components of the device of FIG. 1 including the front speaker and the enclosure system.

Referring to FIG. 2, functional elements, modules, components and systems of device 10 are provided. The functional elements are generally electronic or electro-mechanical devices mounted within a housing. Many devices are also mounted on an internal substrate, such as a printed circuit board (PCB). A substrate is any generally planar rigid platform. In one embodiment, PCB 76 is a substrate for mounting and supporting the internal components on both of its top and bottom sides and provides some electrical circuitry for the devices, as defined by etchings within the layers of plastic and copper. As such, components can be more densely packed thereon, thereby reducing the size of PCB 76. PCB 76 is securely mountable within housing 12, typically via screws. PCB 76 is a generally planar sandwich of layers of plastic (or FR4) and copper. PCB 76 allows components to be placed on both of its sides ("top" and "bottom"). Some components may require isolation or sufficient physical separation from other components. For example, radio frequency (RF) signals from antenna may interfere with the operation of other devices. Shielding may be provided. Further details on these components and layouts are provided below.

Microprocessor 30 is provided to control and receive almost all data, transmissions, inputs and outputs related to device 10. Microprocessor 30 is shown schematically as coupled to keys 24, touchpad, display 14 and other internal devices. Microprocessor 30 controls the operation of display 14, as well as the overall operation of device 10, in response to actuation of keys 24 and keys on touchpad. Exemplary microprocessors for microprocessor 30 include microprocessors in the Data 950 (trade-mark) series, the 6200 series and the PX900 series, all available at one time from Intel Corporation.

In addition to microprocessor 30, other internal devices of device 10 include: a communication subsystem 34; a short-range communication subsystem 36; touchpad; and display 14; other input/output devices including a set of auxiliary I/O devices through port 38, a serial port 40, a front speaker 16A, a back speaker 16B, and a microphone port 32 for microphone 28; and memory devices including a flash memory 42 (which provides persistent storage of data) and random access memory (RAM) 44; persistent memory 74; clock 46 and other device subsystems (not shown).

Speakers are provided to generate audible output signals for device 10, for example, received voice signals for telephone calls, music from digital signals, enunciator signals generated by applications operating on device 10. Front speaker 16A is provided as a main audible signal generator. Rear speaker 16B is an auxiliary speaker and may be used to generate louder audio signals, for example for a speaker phone operation. One or both of speakers 16A and 16B may be selected and tuned to operate in an acoustic frequency range suitable for telephone voice transmissions, where a focus is typically placed on response characteristics of signals between about 300 Hz and about 3,300 Hz. Other ranges can be focused on depending on particular acoustic performance goals of the speaker(s). There may be more than one front speaker 16A. Back speaker 16B may be provided on the back side of housing 12B, but may also be provide on other locations in device 10, such as on its side or even on its front in its housing 12. Components in device 10 provide and generate electrical signals for speakers 16, which when received by speakers 16 are converted to acoustic signals per typical operation of a speaker. Other types and sizes of speakers may be used including speakers having cone diaphragms. Enclosure system 70 may be provided for speaker 16A and/or 16B to adjust response characteristics of the speaker. Further detail on the relationships between speaker 16A and enclosure system 70 is provided below.

Communication functions, including data and voice communications, are performed through communication subsystem 34 and short-range communication subsystem 36. Collectively, subsystem 34 and subsystem 36 provide a signal-level interface for all communication technologies processed by device 10. Communication subsystem 34 includes receiver 50, transmitter 52 and one or more antennas, illustrated as receive antenna 54 and transmit antenna 56. In addition, communication subsystem 34 also includes processing module, such as digital signal processor (DSP) 58 and local oscillators (LOs) 60. The specific design and implementation of communication subsystem 34 is dependent upon the communication network in which device 10 is intended to operate including one or more of a Mobitex (trade-mark) Radio Network ("Mobitex") and the DataTAC (trade-mark) Radio Network ("DataTAC"). Voice-centric technologies for cellular device 10 include Personal Communication Systems (PCS) networks like Global System for Mobile Communications (GSM) and Time Division Multiple Access (TDMA) systems. Certain networks provide multiple systems including dual-mode wireless networks include Code Division Multiple Access (CDMA) networks, General Packet Radio Service (GPRS) networks, and so-called third-generation (3G) networks, such as Enhanced Data rates for Global Evolution (EDGE) and Universal Mobile Telecommunications Systems (UMTS). Other network communication technologies that may be employed include, for example, Ultra Mobile Broadband (UMB), Evolution-Data Optimized (EV-DO), and High Speed Packet Access (HSPA), etc.

In addition to processing communication signals, DSP 58 provides control of receiver 50 and transmitter 52. For example, gains applied to communication signals in receiver 50 and transmitter 52 may be adaptively controlled through automatic gain control algorithms implemented in DSP 58.

Short-range communication subsystem 36 enables communication between device 10 and other proximate systems or devices, which need not necessarily be similar devices. For example, the short-range communication subsystem may include an infrared device and associated circuits and components, or a Bluetooth (trade-mark) communication module to provide for communication with similarly-enabled systems and devices.

Operating system software executed by microprocessor 30 is preferably stored in a computer readable medium, such as flash memory 42, but may be stored in other types of memory devices (not shown), such as read only memory (ROM) or similar storage element. In addition, system software, specific device applications, or parts thereof, may be temporarily loaded into a volatile storage medium, such as RAM 44.

Microprocessor 30, in addition to its operating system functions, enables execution of software applications on device 10. A set of software applications 48A-I that control basic device operations, such as voice communication module 48A and data communication module 48B, may be installed on device 10 during manufacture or downloaded thereafter.

Persistent memory 74 may be a separate memory system to flash memory 42 and may be incorporated into a component in device 10, such as in microprocessor 30. Additionally or alternatively, memory 74 may removable from device 10 (e.g. such as a SD memory card), whereas flash memory 42 may be permanently connected to device 10.

Display 14 has backlight system 64 to assist in the viewing of display 14, especially under low-light conditions. A backlight system is typically present in a LCD. A typical backlight system comprises a lighting source, such as a series of LEDs or a lamp located behind the LCD panel of the display and a controller to control activation of the lighting source. To assist with one method of adjusting the backlight level, light sensor 66 is provided on device 10. Sensor 66 may be located anywhere on device 10, having considerations for aesthetics and operation characteristics of sensor 66.

Powering electronics of the mobile handheld communication device is power source 62 (shown in FIG. 2 as "battery"). The power source 62 may be one or more batteries. The power source 62 may be a single battery pack, such as a rechargeable battery pack. Alternative power source(s) may be provided. A power switch (not shown) provides an "on/off" switch for device 10.

Now, brief descriptions are provided on the applications 48 stored and executed in device 10. Voice communication module 48A handles voice-based communication such as telephone communication, and data communication module 48B handles data-based communication such as e-mail. In some embodiments, one or more communication processing functions may be shared between modules 48A and 48B.

Additional applications include calendar 48C which tracks appointments and other status matters relating to the user and device 10. Calendar 48C is activated by activation of calendar icon 26A on display 14. Address book 48D enables device 10 to store contact information for persons and organizations. Email application 48E provides modules to allow user of device 10 to generate email messages on device 10 and send them to their addressees. Calculator application 48F provides modules to allow user of device 10 to create and process arithmetic calculations and display the results through a GUI.

Any application in device 10 may produce any output signal through components on device 10. For example, visual output may be provided through text and/or graphics generated on display 14. Additional separate lights and LED may provide additional output indicators. Audible output signals (e.g. received voice signals for telephone communications, audible enunicators (e.g. "beep" signals) may be generated as output signals provided by speaker 16A. A buzzer in device 10 may provide another tactile feedback signal for an application.

Database 72 is provided to store data and records for applications 48 and other modules and processes. Database 72 may be provided in flash memory 42 or in another data storage element.

With some features of device 10 described above, further detail is provided on notable features of an embodiment, relating to a transducer and an enclosure system for the transducer.

Acoustic and electrical properties of a transducer may be modified by providing one or more enclosures, capturing a volume of air, around parts of the transducer. As such, operational characteristics of a transducer, such as the resonant frequency and/or Q factors of the transducer, may be modified from its typical ambient operational characteristics. A transducer may be a microphone, speaker or other device. When the transducer is a speaker, enclosure(s) may be provided to tune frequency response characteristics of the speaker. For example, an enclosure may be provided to reduce back-wave noise and/or to tune a resonant frequency for the speaker to a specific value. One or more enclosures may be provided forming an enclosure system for the speaker. Each enclosure may be a suitably sized cabinet to enclosure a specified volume of air around a part of the speaker. There may be one or more ports in an enclosure. An enclosure may provide additional functions for other components in device 10, such as radio frequency (RF) shielding. An enclosure may be formed using part of other components in device 10, such as formations provided in housing 12 and/or walls provided by PCB 76.

An aspect of an embodiment provides a first acoustic resonator connected to one side of an acoustic transducer and infinite surrounded air. Another aspect provides a second acoustic resonator is connected to the ear of the user on one side and to the other side of the transducer as soundgiving device on the other side. An acoustic resonator is realized by a system having a cavity that is filled with air and that is directly attached to either side of the transducer and a port attached to the cavity with an opening. The resonance frequency of the resonator is defined by the volume of air that is inside the cavity and a length and cross-section of the port. The combination of both acoustic resonators may be used with different resonating frequencies of the transducer to improve the target parameter acoustic frequency response in terms of linearity and bandwidth of the acoustic system in the used environment.

An embodiment may further comprise an enclosure to either one side of the acoustic transducer and at least one aperture to allow air and sound venting outside of said device to be in communication with said either side of the transducer. There may be an acoustic resistance integrated in or on first the aperture. The resistance may be realized with acoustic meshes. In one embodiment, one acoustic resonator aperture may be connected to the ear of the user of the electronic device. The other said acoustic resonator aperture may be connected to the infinite surrounding air. The acoustic resonator system may equalize a frequency response of the transducer at the aperture connected to the ear of the user in a frequency range of between about 1 kHz and 3.5 kHz.

Figure 3:
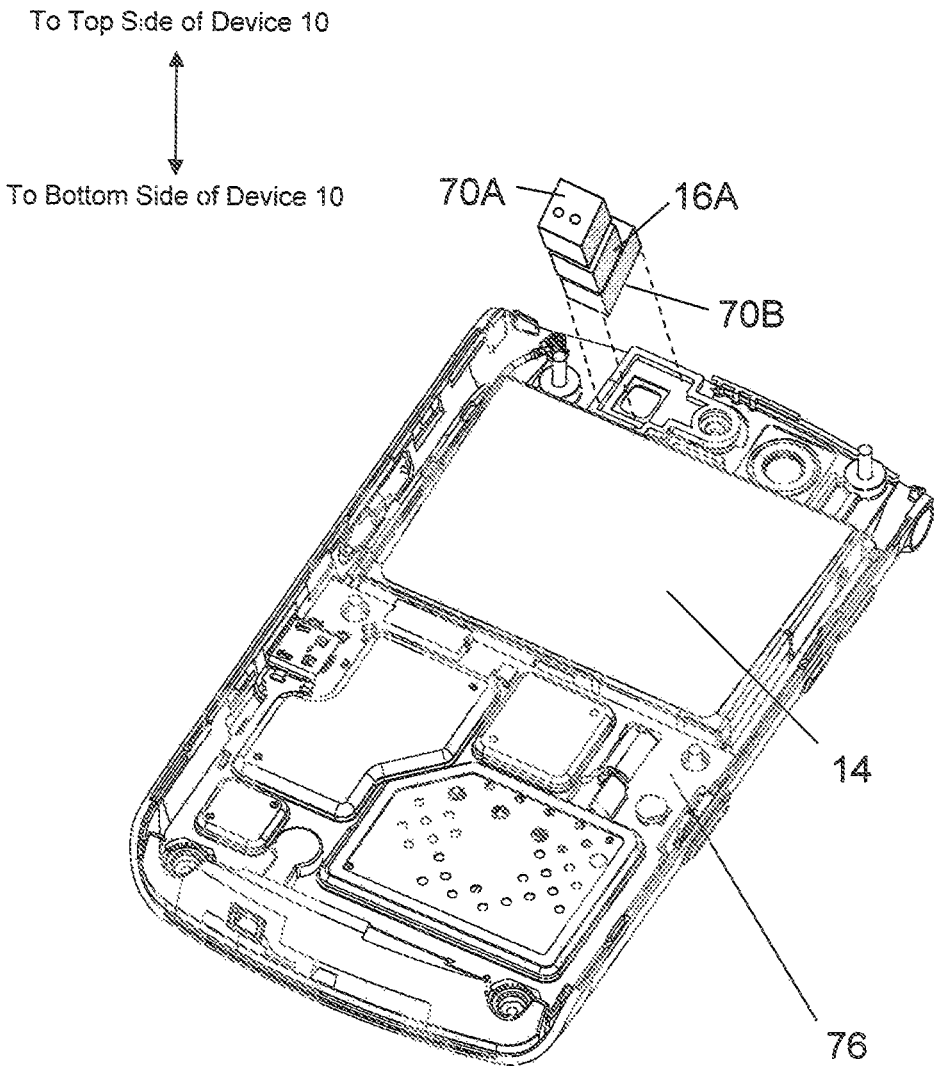
FIG. 3 is a front perspective exploded view of internal components of the device of FIG. 1 showing the bottom housing with internal components, including the front speaker and enclosure system, mounted on a printed circuit board (PCB)

FIGS. 3 to 13 provide further detail on aspects of an embodiment. Position/direction terms (e.g. front, back, left, right, etc.) are used herein to identify relative positions and directions for certain elements of device 10 (e.g. "There is a left side and a right side of the device"). Generally, when device 10 is held in its expected orientation by a user, display 14 faces the user. For example, device 10 in FIG. 1 may be held by a user in his hand such that display 14 is oriented in the user's hand to be above keys 24. When device 10 is viewed in such an orientation, the "front" side of device 10 is the side facing the user; the "back" side of device 10 is the side contacting the palm of the user's hand; the "top" side of device 10 is the upper end of device 10 (where speaker 16A is located) that extends away from the user when device 10 is being held; and the "bottom" side of device 10 is the lower end of device 10 (when keys 24 are located) that extends away from the user when device 10 is being held. For the purposes of illustration, references to front side, back side, left side, right side, and top and bottom ends are provided using the orientation markings relative to the side view of device 10 as shown in FIG. 3. It will be appreciated that the terms "top" and "upper" may be used interchangeably the "front" side and the "top" end of device 10 and similarly that the terms "bottom", "rear" and "lower" may be used interchangeably with the "back" side of device 10. Similarly, dimension terms like "width", "length", "height" and "depth" can be applied to different features of an element depending on a current perspective. The relative positions and directions will be clear in the context of the use of the terms. These references provide relative positional references for components for convenience only and are not meant to be limiting, unless otherwise noted.

Figure 4:
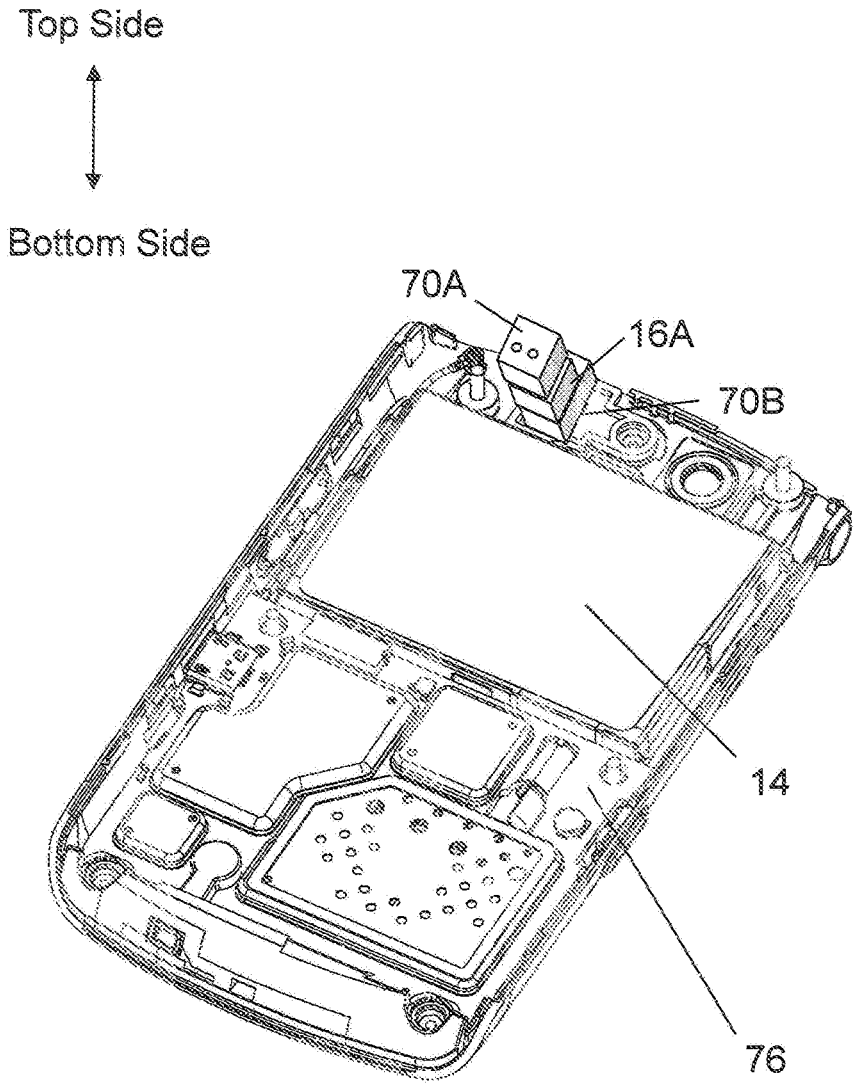
FIG. 4 is a front perspective view of a top side of the PCB of the device of FIG. 1 showing top components, including the front speaker and front and back enclosures of the enclosure system.
Figure 5A:
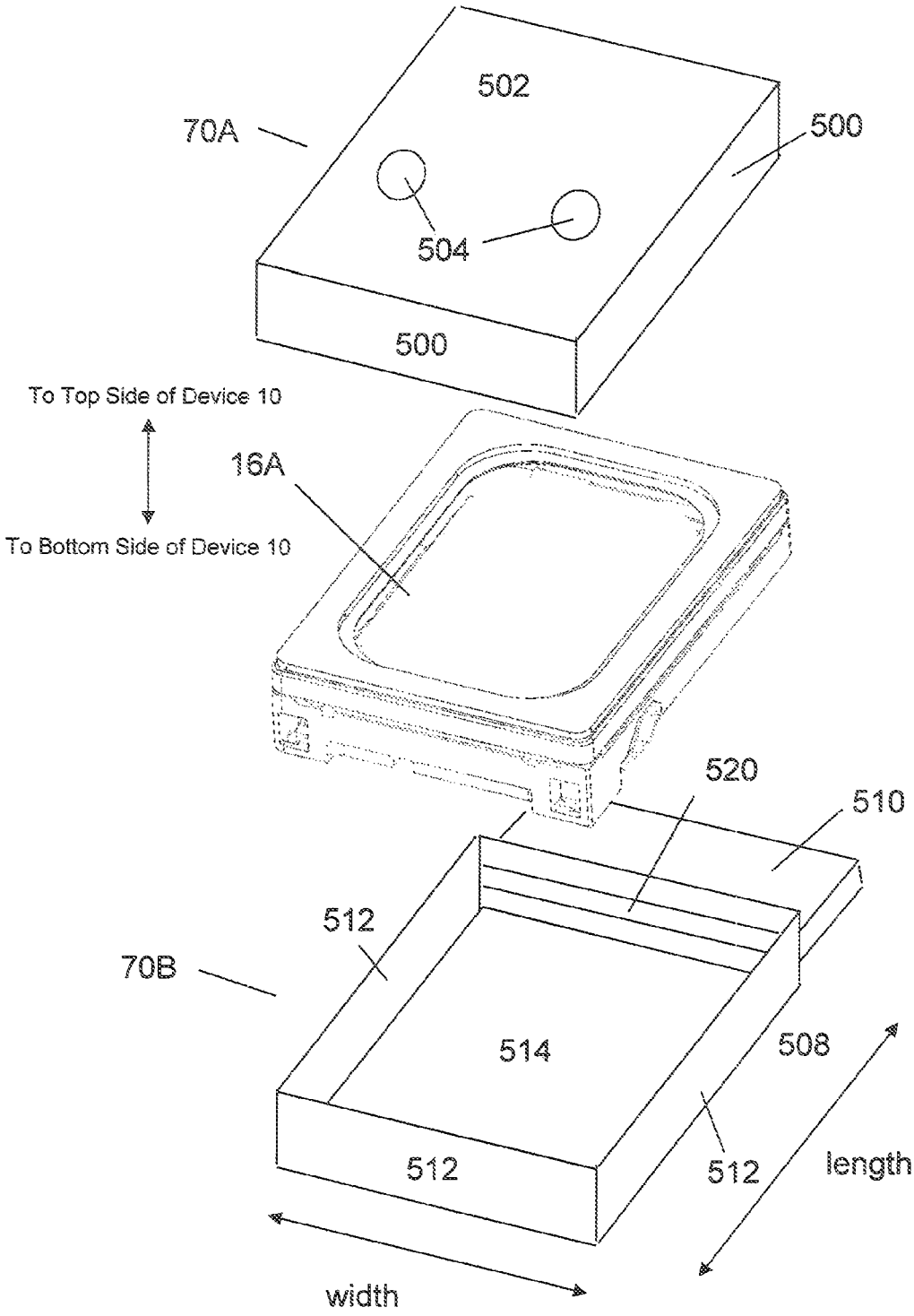
FIG. 5A is a front exploded perspective view of the front speaker and front and back enclosures of FIG. 4.
Figure 5B:
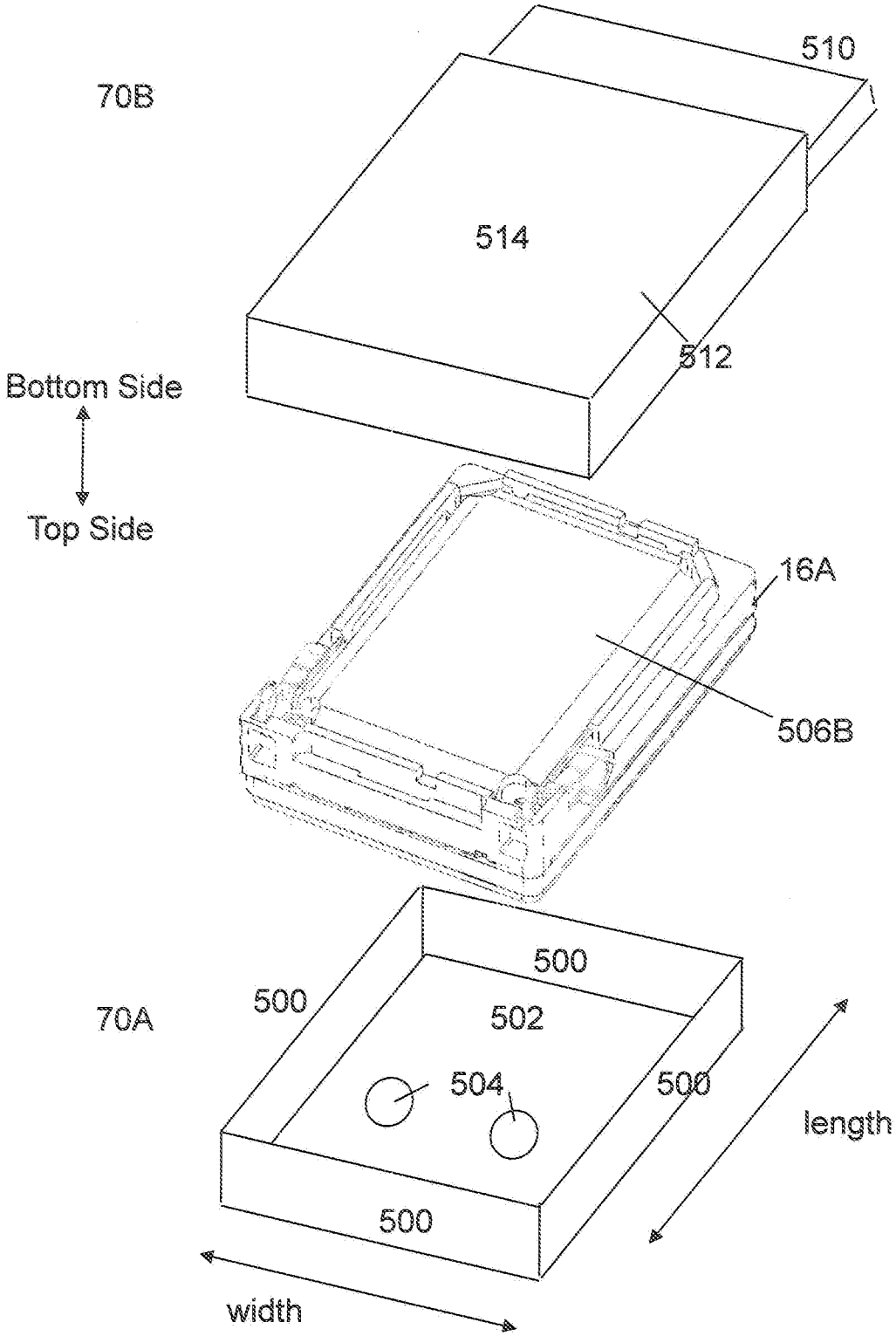
FIG. 5B is a bottom exploded perspective view of the front speaker and the front and back enclosures of FIG. 4.
Figure 6A:
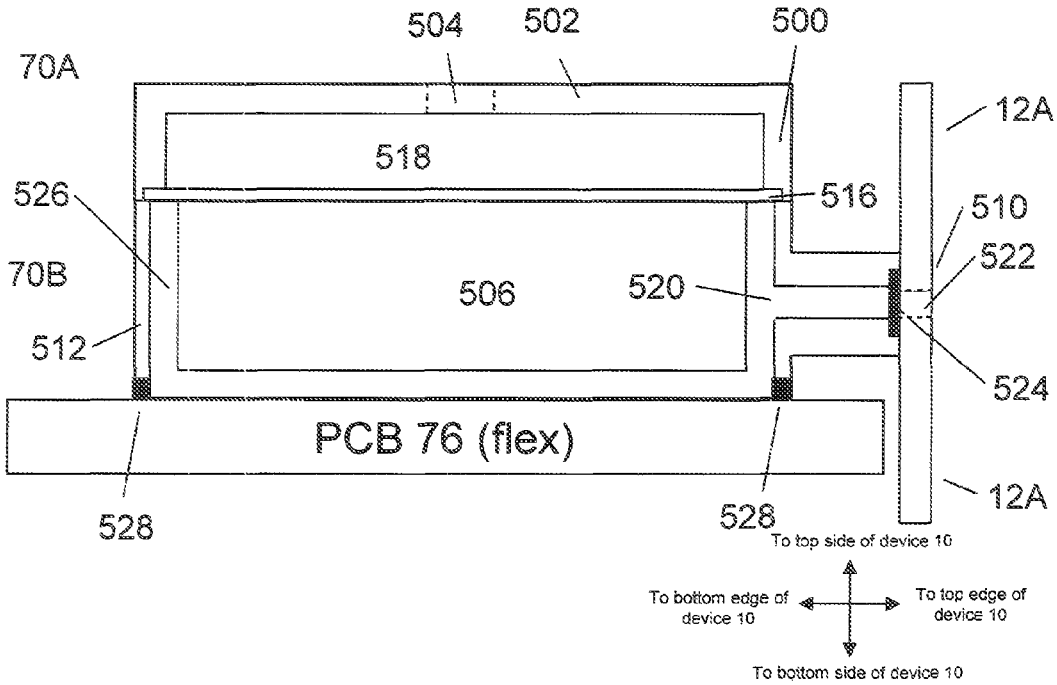
FIG. 6A is a side cross-sectional view of the front speaker and the front and back enclosures mounted on the PCB of FIG. 4.
Figure 6B:
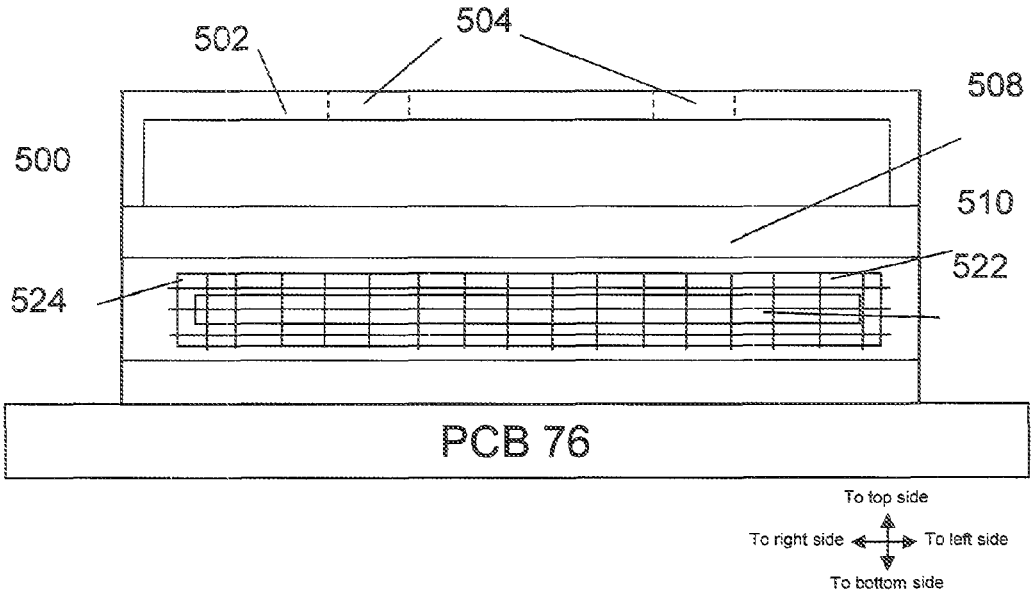
FIG. 6B is a front cross-sectional view of the front speaker and the front and back enclosures mounted on the PCB of FIG. 4.
Figure 7A:
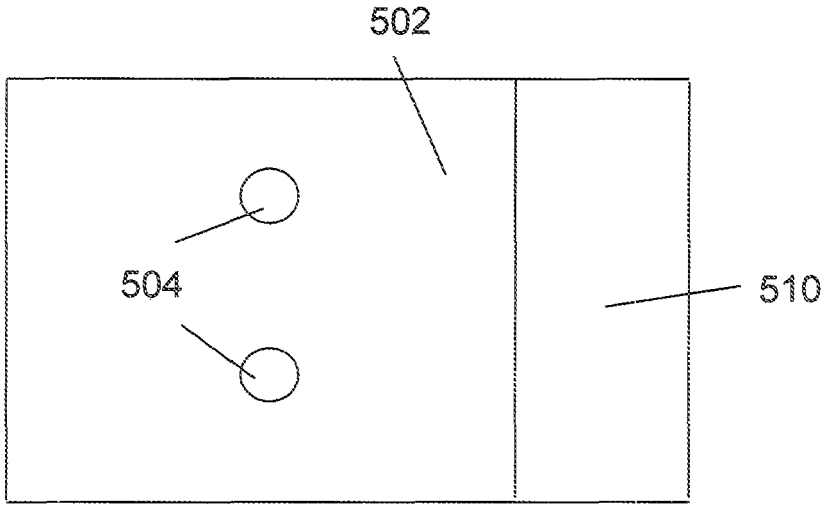
FIG. 7A is a top plan view of the front speaker and the front and back enclosures of FIG. 4.
Figure 7B:
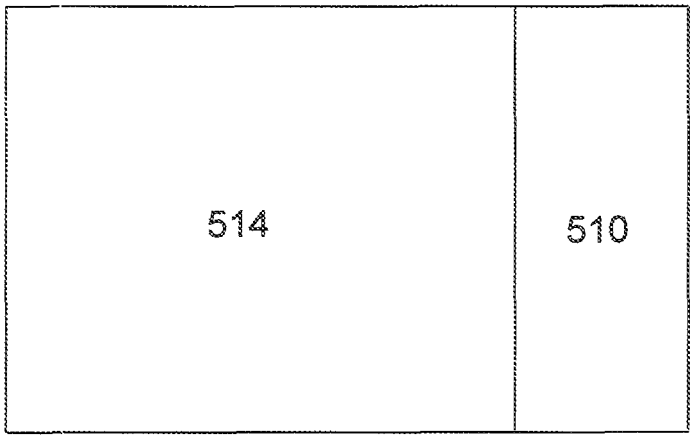
FIG. 7B is a bottom plan view of the front speaker and the front and back enclosures of FIG. 4.

Referring to FIGS. 3 and 4, one embodiment of a speaker enclosure is shown, where the speaker enclosure is affixed, integrated, assembled to or otherwise connected with a bottom portion of a housing for a device, namely housing 12B. Front view of housing 12B is shown with components of device 10 populated on PCB 76 shown therein. In particular, speaker 16A is shown with its diaphragm oriented upwards (to project sound out of the front face of device 10, when housing 12A (not shown) is mounted to housing 12B. The enclosure and speaker may be located on or about the top side of the PCB. In one embodiment, being "about" the PCB refers to an enclosure that is not affixed to the PCB. For example, it may be mounted within a space about the PCB, being secured to the housing. In other words, it may be mounted around or proximate to the PCB, without being attached to the PCB. However, in another embodiment, being "about" the PCB refers to an enclosure (or a part thereof) that is affixed to the PCB. Additional enclosures may be provided for other speakers, such as for a speaker mounted on the bottom side of the PCB.

Speaker 16A is mated to enclosure system 70 comprising front enclosure 70A and back enclosure 70B. These components are shown schematically and are not necessarily presented to scale in comparison with other components shown in FIGS. 3 and 4, in particular in regards to their heights. Front enclosure 70A mounts to the top of speaker 16A, forming a volume of air within the interior of the front enclosure around the top of speaker 16A. The back enclosure 70B mounts to the backside of speaker 16A, forming a volume of air within the interior of the back enclosure around the bottom of the speaker. A port (not shown) is provided in back enclosure 70B and connects with aperture 17 (FIG. 1) of housing 12B, to provide an air channel of the back enclosure to ambient air.

Having a back enclosure for the bottom of speaker 16A assists in separating the air surrounding the bottom of the speaker from being in communication with the air surrounding the top of the speaker, which assists in preventing an acoustic short circuit between the top and bottom of the speaker, where the top of the speaker is in communication with the bottom of the speaker. The phrase that a component is "in communication" with another component for this disclosure describes an arrangement where the component is "in contact" with the other component. Contact may be a direct physical contact, where the components touch each other. Contact may be an indirect physical contact, where a linking component provides an interface to transmit a movement of one component to the other component. When describing acoustic properties, two components that are "in communication" with each other when audible signals generated or carried by one component are transmitted to and received by the other component, either directly or through free air or through some type of connecting channel, volume or conduit. Each part of enclosure system 70 may be formed from plastic, metal and/or other materials. Paint or a coating may be provided to the interior surfaces of system 70.

Referring to FIGS. 5A, 5B, 6A, 6B, 7A and 7B, front enclosure 70A provides an enclosure for a volume of air over the top of the diaphragm of speaker 16A. An exemplary speaker which may be used in an embodiment is a speaker the size of approximately 11 mm×15 mm×3.5 mm. For an exemplary embodiment, the shape of the interior volume of front enclosure 70A is rectangular, as the diaphragm of speaker 16A is rectangular and has dimensions to mate with the speaker. Other shapes for a front enclosure may be provided to mate with the shape of the speaker. In one embodiment the exterior dimensions for the front enclosure are approximately 11 mm long by 15 mm wide by 1 mm high. As such, the exterior shape of front enclosure 70A has a four vertical walls 500 and a top section 502, all connected and joined to form a box shape, with an open bottom. With the provided speaker 16A, the volume of the front enclosure provides a volume of approximately 0.15 $cm^3$ above the front of speaker 16A. Different volume sizes, structures and shapes may be provided depending on the response characteristics wanted and the physical dimensions of the speaker. For a given top view shape of a diaphragm of a given speaker 16A, different dimensions of volumes for front enclosure 70A may be provided. Exemplary additional volumes may be hemispherical, columnar, ovoid or any combination of such volumes. In other embodiments, parts of top enclosure 70A may be provided by other components in device 10. For example, one or more sides may be provided via structures formed on housing 12A. A gasket (not shown) may be provided at the connection surfaces between front enclosure 70A and the top of speaker 16A.

In order for the sound generated by speaker 16A to leave front enclosure 70A, apertures 504 are provided in the top surface of front enclosure 70A. Apertures 504 are round and are approximately 0.8 mm in diameter. They are located about the center in the top surface. Acoustic mesh (not shown) may be placed over one or both of apertures 504. In other embodiments, more or less apertures may be provided, with different shapes, sizes and dimensions for the apertures.

Back enclosure 70B provides an enclosure for a volume of air for bottom portion 506 of speaker 16A. In an embodiment back enclosure 70B is provided two sections: a main enclosure 508 and a port 510. In one embodiment the exterior dimensions for back enclosure 70B are approximately 13 mm long by 15 mm wide by 4 mm high. In other embodiments, a port may not be provided.

Main enclosure 508 is a box is shaped to receive bottom portion 506 of speaker 16A. As such, a magnet in the bottom portion 506 of speaker 16A may rest inside the volume of back enclosure 70B. Other shapes for the main enclosure may be provided to mate with the shape of the speaker. For a rectangular shaped speaker 16A, main enclosure 508 is rectangular having four vertical walls 512 and a bottom part 514 connected and joined to form a box shape, with an open top. The top edge of the four walls 512 define a cross section that allows bottom portion 506 of speaker 16A to extend into main enclosure 508, while a frame 516 of a diaphragm 518 of speaker 16A rests on the top edge of walls 512. In one embodiment the exterior dimensions for main enclosure 508 are approximately 13 mm long by 15 mm wide by 4 mm high. When speaker 16A is placed main enclosure 508, a volume of air 526 is captured around the bottom portion 506 within main enclosure 508 between the transducer and the enclosure. The volume may be (relatively) very small, in the order of approximately 0.2 $cm^3$ or less. Different volume sizes and shapes may be provided depending on the response characteristics wanted and the physical dimensions of speaker 16A. A gasket (not shown) may be provided at the connection surfaces between back enclosure 70B and the frame of speaker 16A. In other embodiments, parts of the main enclosure may be provided by other components in device 10. For example, the bottom may be provided by PCB 76 and one or more sides may be provided via structures formed on housing 12A.

Port 510 of back enclosure 70B is a hollow columnar structure extending from a wall 512 of the main enclosure. Its dimensions may vary to suit acoustic tuning properties wanted for specific implementations. In one configuration, port 510 has a (first) proximal end and a (second) distal end: the proximal end of port 510 is connected to wall 512 of main enclosure 508; the distal end of port 510 is connected to an opening in housing 12. This opening in housing 12 is separate from aperture 17 for the main output generated by the front of speaker 16A. In one embodiment it has a length of approximately between 1 and 2 mm and a width of approximately 15 mm. The interior dimension of port 510 is approximately 0.5 mm high and 1.5 mm wide and 2 mm long. An opening 520 in wall 512 of main enclosure 508 connects to the interior of port 510. Port 510 extends to the top of the enclosure has another opening 522 at its distal end. The dimensions of opening 522 are approximately 1.5 mm high by 6 mm wide, providing a cross sectional area of approximately 9 $mm^2$ towards the infinite surrounding. In other embodiments, other shapes and dimensions for the opening at the distal end of port 510 may be provided. An acoustic mesh 524 may be placed over opening 522. Alternatively mesh 524 may not be used. As such, there is air communication from the air surrounding the anterior end of port 510 to the bottom portion 506 of speaker 16A through the interior volume provided by main enclosure 508. In one embodiment, port 510 opens to the interior of device 10. In another embodiment, port 510 is connected to an aperture in housing 12A of device 10 to connect the port to the exterior of device 10. The location of the aperture in the housing may be on a top edge of device 10 or on the back cover of device 10. It may be provided as part of top housing 12A, bottom housing 12B or formed by both top and bottom housings 12A and 12B. In one embodiment, the aperture for port 510 is in a spaced relationship from aperture 17 (FIG. 1) on device 10, such that when device 10 is held to a user's ear with the user's ear covering opening 17 (so that he can best hear the sounds generated by speaker 16), the aperture for port 510 is not covered by the user's ear. One or more ports may be provided in one or more locations on the sides of the main enclosure. A seal, such as Poron (trademark) seal 528 may be provided between box 512 and PCB 76. In one embodiment, back wall 514 is not directly part of enclosure 508 as wall 514 is assembled to enclosure 508 when the device is assembled. The PCB 76 may be a flex PCB that is mounted to wall 514.

An embodiment may utilize any combination of any of size of opening 522, the length of port 510 and the size of the volume of back resonator to adjust frequency response characteristics of speaker 16A to tune the resulting frequency response to desired response characteristics, within desired operating ranges.

Referring to FIGS. 8A to 8D, in another embodiment, speaker 16A and enclosure system may alternatively or additionally be affixed, integrated, assembled to or otherwise connected to a top portion of a housing for a device, namely housing 12AA.

Figure 8A:
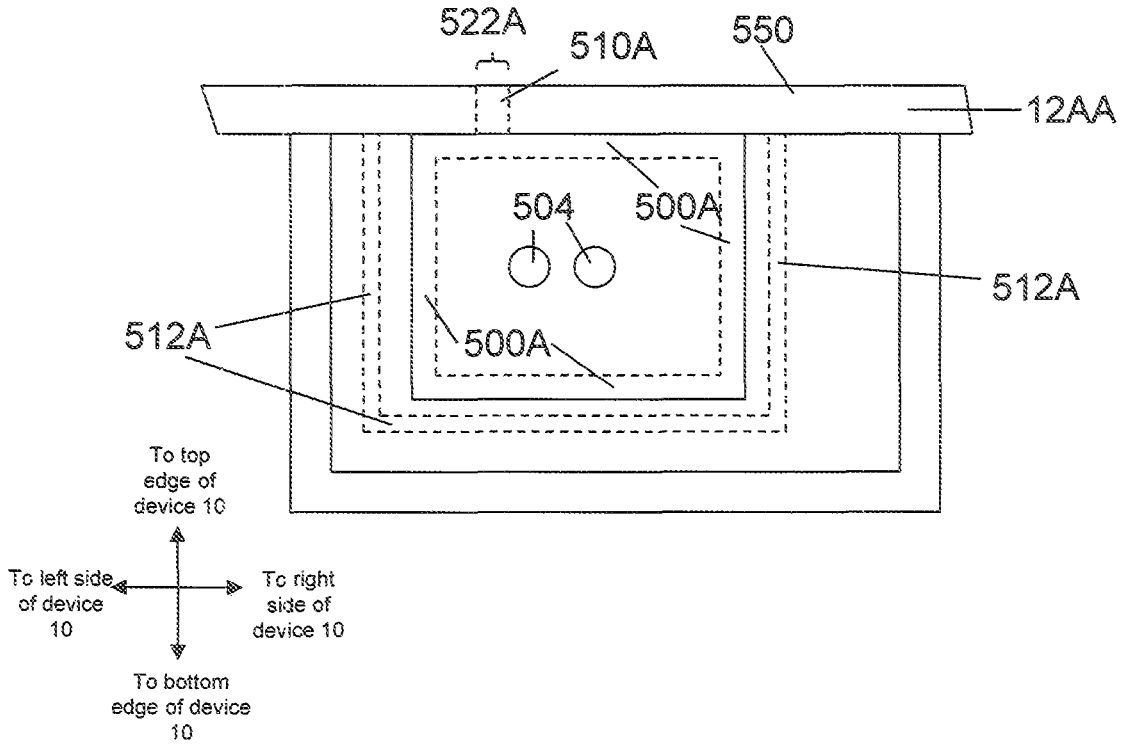
FIG. 8A is a cross-section top plan view of internal components of an alternative embodiment of the device of FIG. 1 showing a portion of the top housing with an enclosure system that is integrated into the top housing.
Figure 8B:
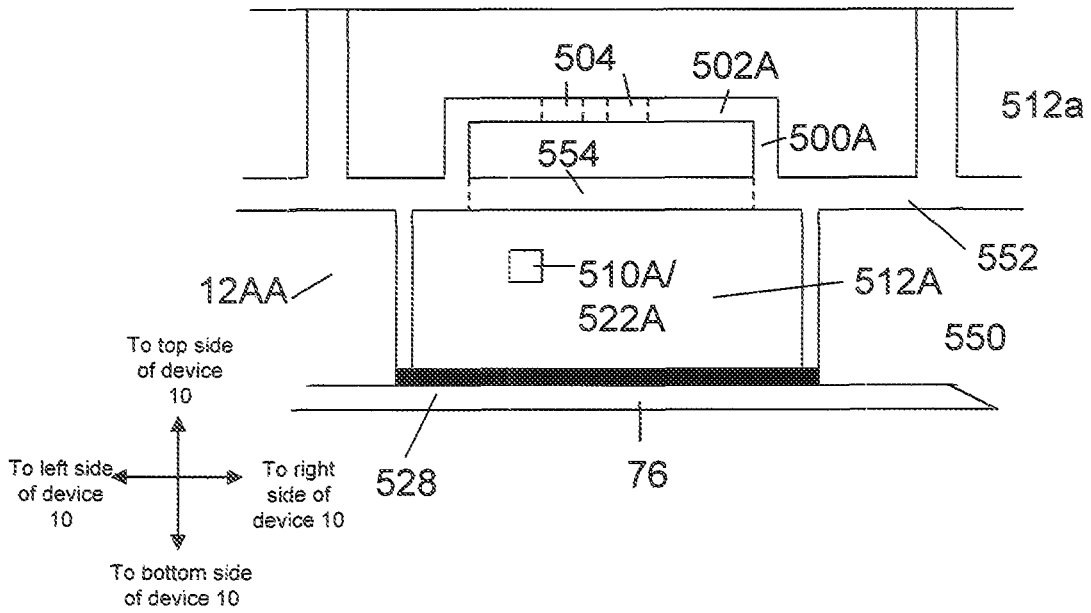
FIG. 8B is a cross-section front plan view of internal components of the top housing of FIG. 8A with the enclosure system.

FIGS. 8A to 8D show a portion of upper housing 12AA that has enclosure system 70 integrated as part of its elements in its internal bracing structure. FIG. 8A shows a top plan view of a top portion of housing 12AA. Housing 12AA has exterior frame 550 which forms a part of the exterior frame protecting internal components of device 10 from its ambient environment.

Figure 8C:
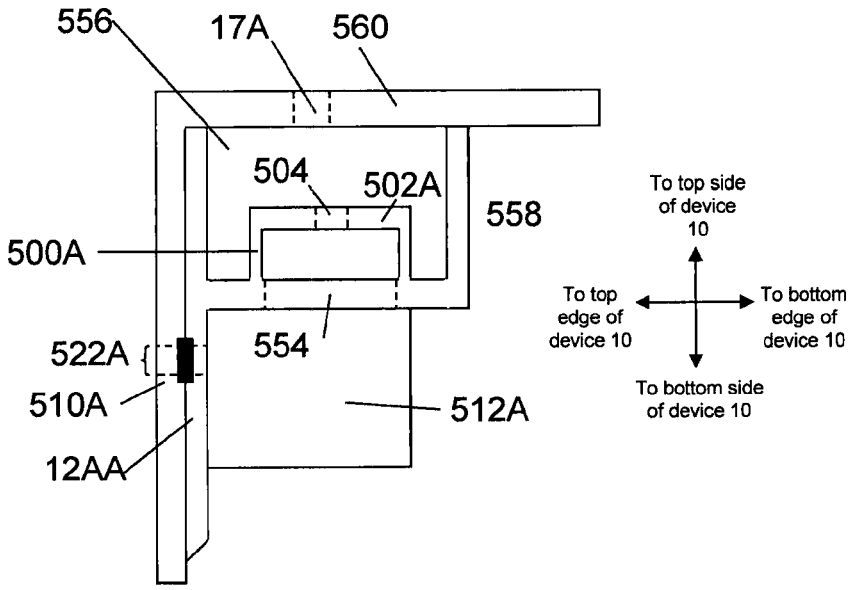
FIG. 8C is a cross-section side plan view of internal components of the top housing of FIG. 8A with the enclosure system.

Front enclosure 70AA is integrated as part of the formation of housing 12AA. Front enclosure 70AA is formed as a box structure having walls 500*a* projecting upwardly from internal ledge 552 on housing 12AA. Cap 502*a* is provided with apertures 504*a* therein. Also, rear enclosure 70BB is formed as a structure of housing 12AA underneath ledge 552, formed by its walls 512A. In exterior frame 550, opening 522A in housing 12AA is provided that provides an air channel of communication to the interior of rear enclosure 70BB. The perimeter of walls 512A on ledge 552 are dimensioned so that at least a part of speaker 16A will fit snugly into enclosure 70A while having enclosure 70B form a cavity behind it. Opening 554 is provided on ledge 552 so that speaker 16A can be placed inside enclosure 70A. Above front enclosure 70AA, opening 17A is provided bounded by walls 558. In FIG. 8C, the housing of device 10 is shown to further comprise cover 560 which mounts over housing 12AA to cover opening 554. Opening 17A is provided on the top of cover 560 to allow a user to press his ear thereagainst to be as close as possible to the output of speaker 16A. Port 510A is provided in housing 12AA to connect the interior of back enclosure 70BB with the ambient environment outside device 10; the thickness of housing 12AA defines the length of port 510A. Opening 522A is provided at the end of cover 560 at the end of port 510A. An acoustic mesh 524A may be placed over within port 510A. The bottom of enclosure 70BB is bounded by PCB 76. The bottom edges of walls 512A may have gasket 528 affixed thereto.

Figure 8D:
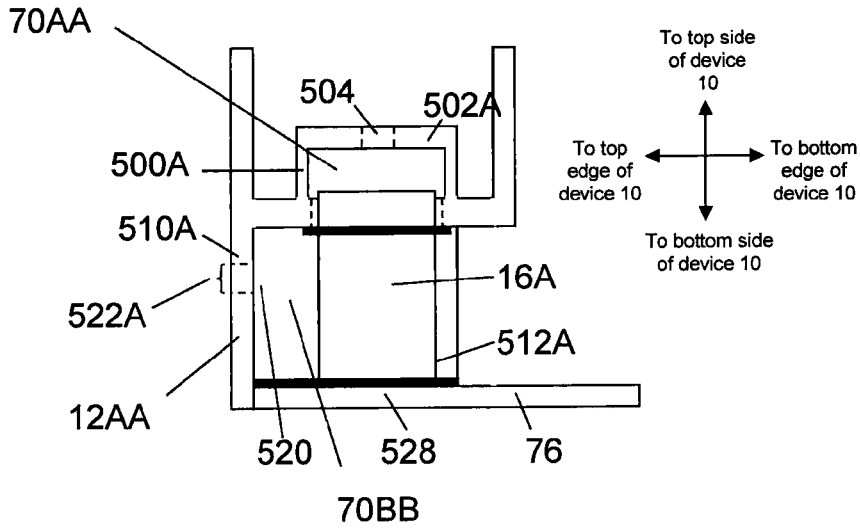
FIG. 8D is a cross-section side plan view of internal components of the top housing of FIG. 8C with the enclosure system with a speaker.

FIG. 8D provides another side view of the housing of FIG. 8C without cover 560 with speaker 16A mounted in opening 554. PCB 76 and gasket 528 seal the bottom of rear enclosure 70BB.

It will be appreciated that structures in either of housing 12AA or 12BB can be formed to collectively define enclosures 70AA, 70A and/or 70BB or 70B.

Figure 9A:
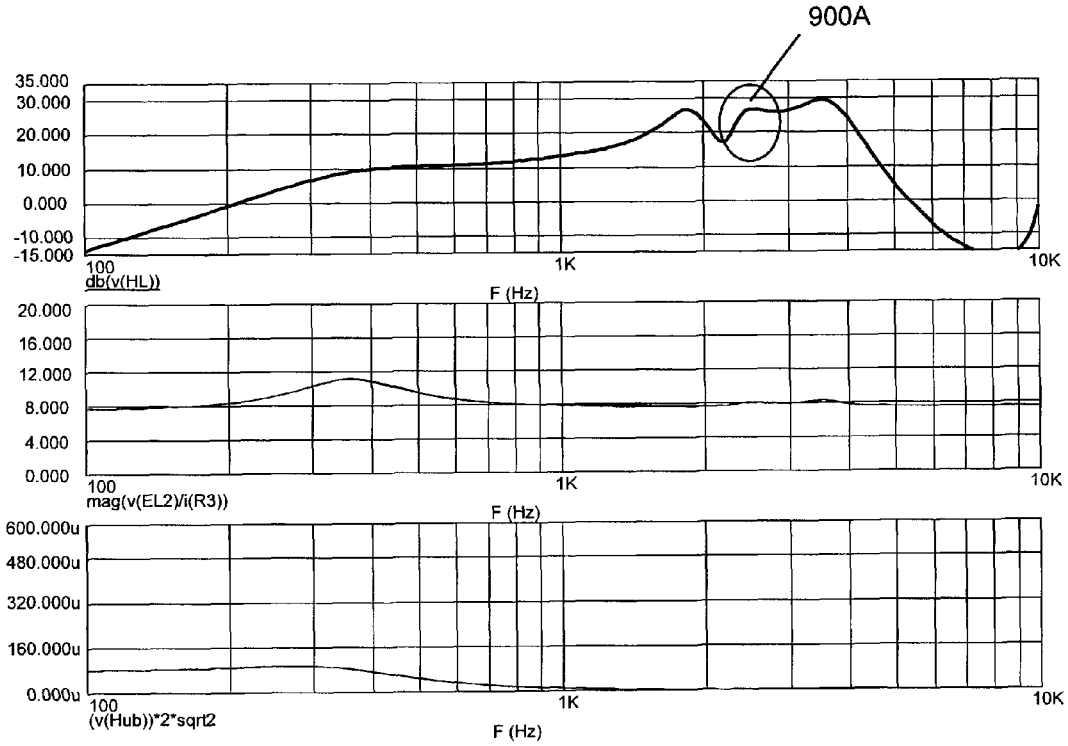
FIG. 9A is a set of frequency response graphs showing experimental data of the front speaker in accordance with an embodiment having an enclosure system of FIG. 4.
Figure 9B:
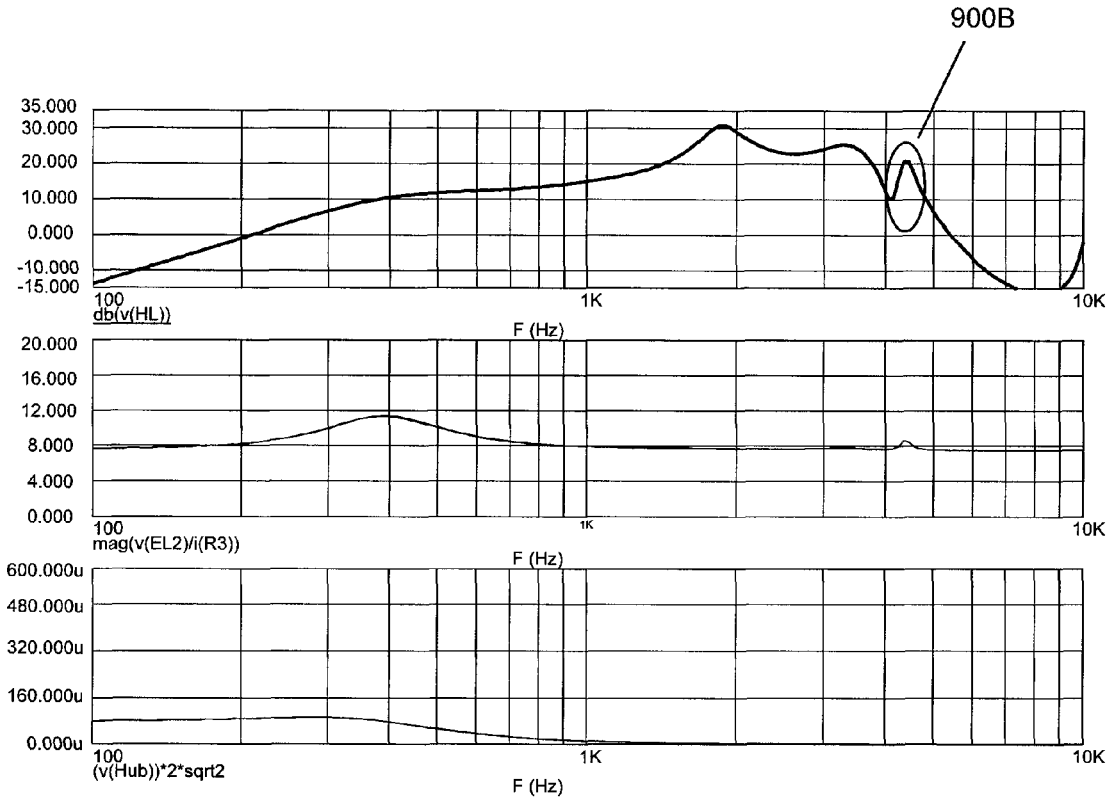
FIG. 9B is a set of frequency response graphs showing experimental data of the front speaker in accordance with an embodiment having an alternative enclosure system from that of FIG. 9A.
Figure 9C:
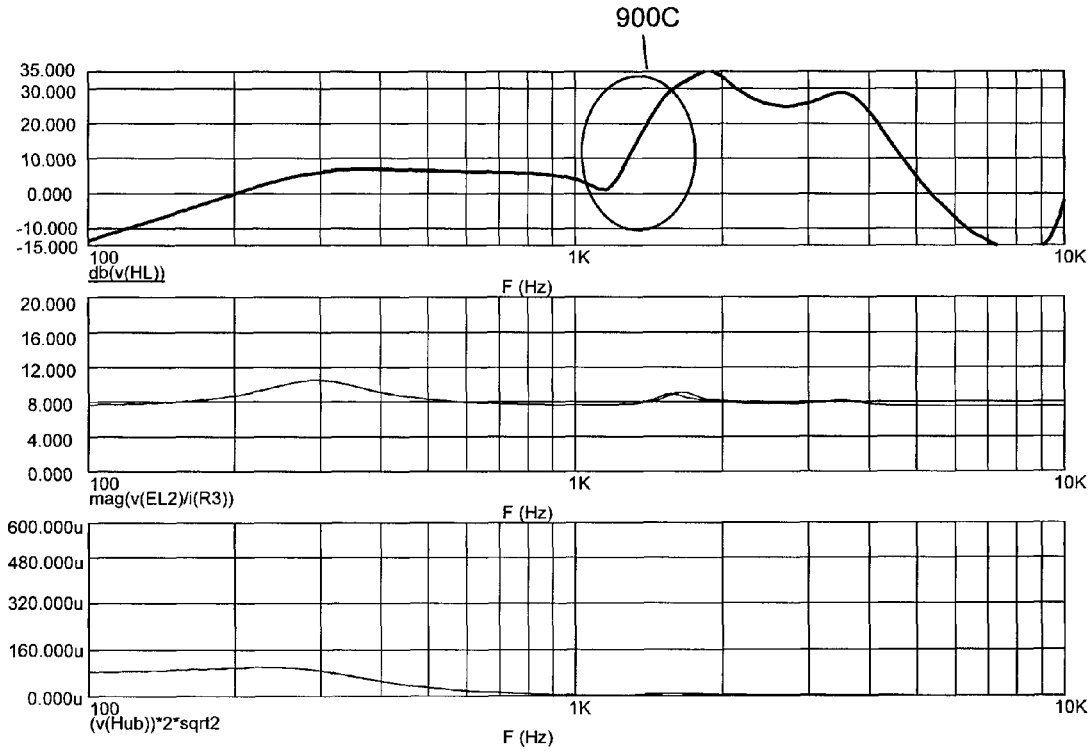
FIG. 9C is a set of frequency response graphs showing experimental data of the front speaker in accordance with an embodiment having another alternative enclosure system from that of FIG. 9A.
Figure 9D:
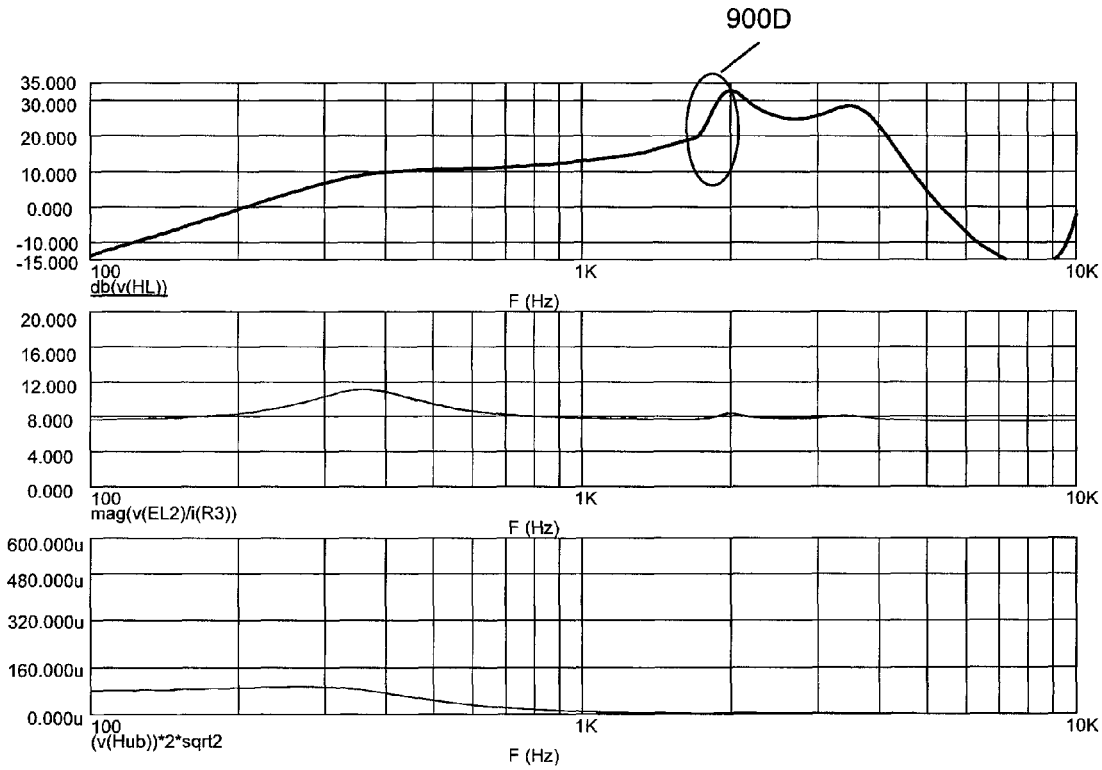
FIG. 9D is a set of frequency response graphs showing experimental data of the front speaker in accordance with an embodiment having yet another alternative enclosure system from that of FIG. 9A.

Some experimental measurement data providing exemplary performance characteristics of an embodiment are now provided. Referring to FIG. 9A, for an embodiment having speaker 16A with back enclosure 70B and opening 522, the top graph shows a frequency response graph from 100 Hz to 10 kHz in decibels. The middle graph shows the same frequency response graph in magnitude of volts/current. The bottom graph shows the same frequency response graph in Volts (RMS). The back enclosure 70B and opening 522 provide a back resonator for speaker 16A which assists in equalizing high frequency signals (e.g. signals over about 2 kHz) for speaker 16A to about 2 kHz to equalize the ear resonance. Note the peak signal at 900A in the top graph between 2 kHz and 3 kHz. Referring to FIG. 9B three graphs corresponding to those in FIG. 9A are shown, illustrating that as the cross-sectioned area of opening 522 in port 510 gets larger, the resonant frequency of the back resonator increases. Note the peak signal at 900B in the top graph between 4 kHz and 5 kHz. Referring to FIG. 9C, three graphs corresponding to those in FIG. 9A are shown, illustrating that as the length of port 510 increases, the resonant frequency decreases. Note the characteristics of signal at 900C in the top graph between 1 kHz and 2 kHz. Referring to FIG. 9D three graphs corresponding to those in FIG. 9A are shown, illustrating that as the volume of main enclosure 508 increases, the resonant frequency of the back volume resonator decreases. Note the peak signal at 900D in the top graph at about 2 kHz.

Figure 10:
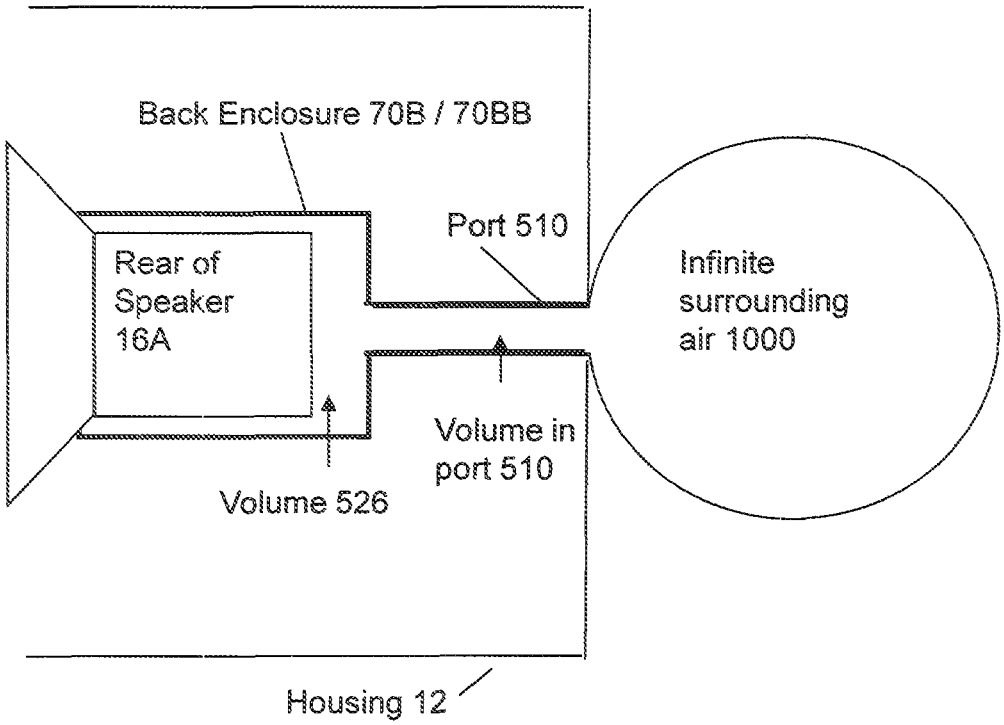
FIG. 10 is a schematic representation of the front speaker and the back enclosure of FIG. 4.

Referring to FIG. 10, a schematic representation of either of back enclosure 70B or 70BB with speaker 16A is shown. Therein, bottom portion 506 of speaker 16A is shown as being enclosed in a volume of air 526 bounded by back enclosure 70B. This volume of air 526 is connected to port 510 which connects to a deemed infinite volume of air 1000. The deemed infinite volume of air may be outside device 10. The deemed infinite amount of air is understood to be, relative to the volume of air in back enclosure 70B or 70BB a volume of air that is effectively, if frequency response calculations are made, an amount of air that is effectively equivalent to being an infinite amount of air compared to the volume of air in port 510. For example the amount of air may be several times in magnitude in volume greater than the volume of air in port 510.

It will be appreciated that the components of enclosure 70A, 70AA, back enclosure 70B, 70BB and speaker 16A may be modelled using analogous "circuits" using electro-mechanical components that provide an analog in an (electrical) circuit to the components in the acoustic system.

Figure 11:
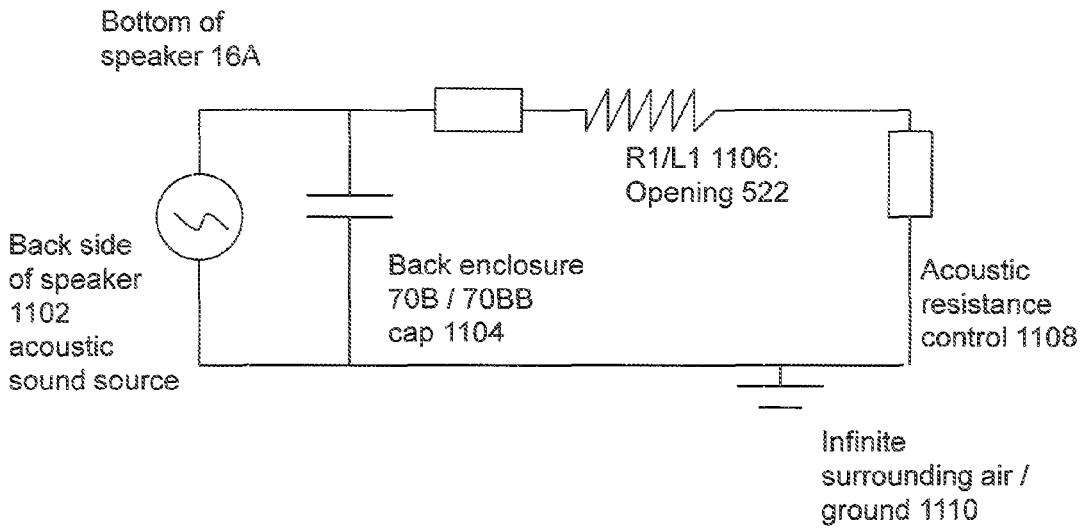
FIG. 11 is block diagram of an electrical circuit representing a model of an electrical circuit for the front speaker and the back enclosure of FIG. 4.

For example, referring to FIG. 11, a block diagram 1100 of an electrical circuit is an analogous electrical circuit to an exemplary acoustic circuit of the back enclosure 70B or 70BB and the back of speaker 16A. Therein, the back portion 506 of speaker 16A is shown as a sound source 1102 which is connected in parallel to a back volume 526 of back enclosure 70B or 70BB, which is modelled as a capacitor 1104. Port 510 is modelled as a resistor/inductor 1106 and is connected in series to an acoustic resistance control module 1108 representing may be an acoustic mesh. The ground 1110 is provided by the infinite volume of air at the end of port 510.

If an embodiment needs to decrease sensitivity of the low frequency response of speaker 16A, the acoustic resistance of the back volume provided by resistor 1106 representing may be an acoustic mesh. The acoustic control module 1108 may be used to modify and tune the sensitivity of a resonance of the speaker 16A to limit maximum excursion for a given input voltage. The back enclosure volume 526 and dimensions of opening 522 in port 510 may also be changed to equalize the frequency in the high frequency range as shown in FIGS. 9A-9E and described earlier. The effect may be controlled with resistance value of the acoustic control module 1108.

Figure 9E:
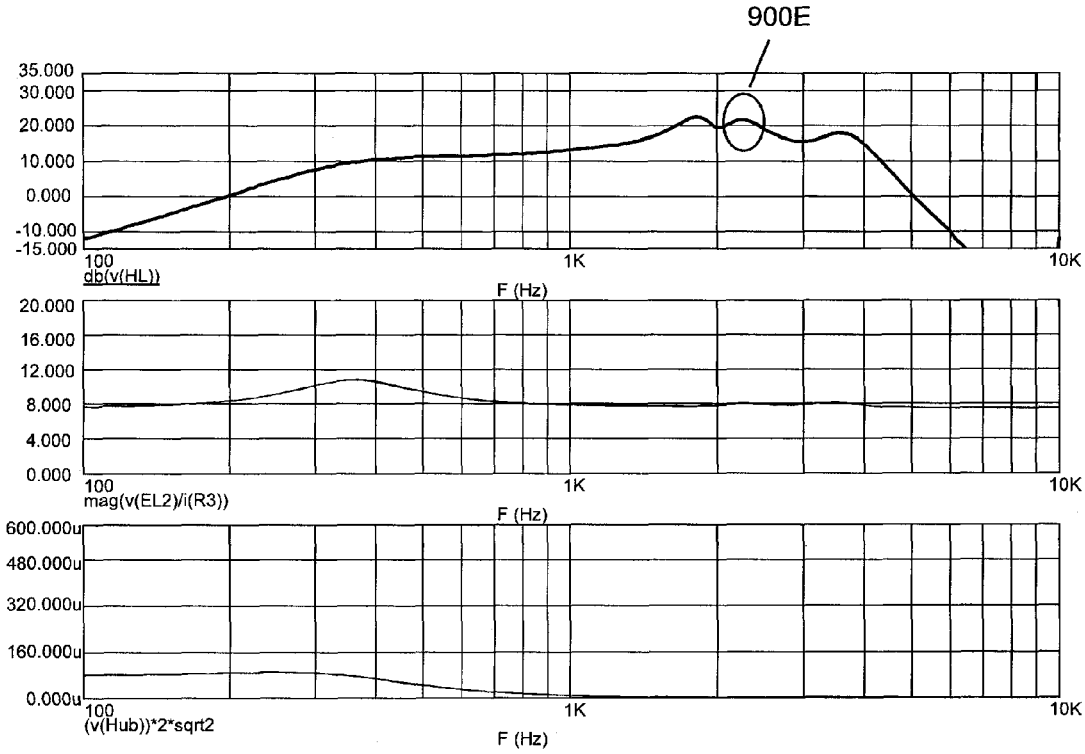
FIG. 9E is a set of frequency response graphs showing experimental data of the front speaker in accordance with an embodiment having an alternative enclosure system from that of FIG. 9A.

In one embodiment, a small band application of front volume resonator has a resonance of approximately 3.5 kHz. A sensitivity drop of approximately 2.5 kHz may be allowable for many applications. Back enclosure 70B or 70BB may be used to equalize the frequency response in a frequency range of between about 2 kHz and 3.5 kHz and may be used to equalize the frequency response in a high leak application. The frequency response of back enclosure 70B or 70BB may be aligned to a frequency which is slightly higher than the ear resonance. The effect may be controlled with resistance value of the acoustic control module 1008. Referring to FIG. 9E, it can be seen that the resistance value is a factor in controlling the Q factor of the resonator. Note the peak signal at 900E in the top graph between 2 kHz and 3 kHz.

In small bandwidth applications, these effects may be combined by adjusting frequency response provided by back enclosure 70B or 70BB to be approximately 2 kHz in small bandwidth applications with low resistance values for resistor/inductor 1006 and acoustic control module 1008. Also, the effects may be combined by adjusting the frequency response provided by back enclosure 70B or 70BB to be in a similar frequency range as the front enclosure 70A or 70AA with low resistance values for resistor/inductor 906 and acoustic control module 1008.

For wideband applications, frequency response modification provided by front and back enclosures 70A, 70AA, 70B and 70BB may be aligned to such that speaker 16A has tuned operating characteristics around the frequency range of between approximately 5 and 6 kHz.

Figure 12:
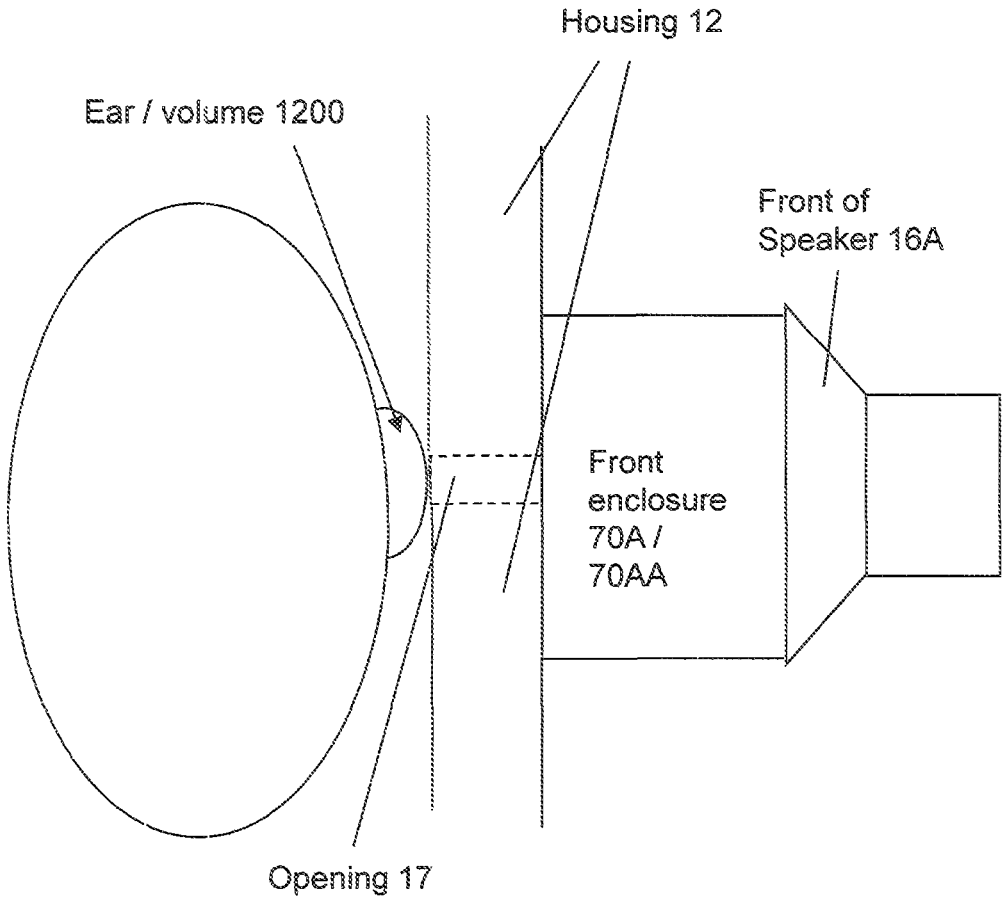
FIG. 12 is a schematic representation of the front speaker and the front enclosure of FIG. 4.

Referring to FIG. 12, a schematic representation of the front enclosure 70A or 70AA with speaker 16A is shown. In use, device 10 is placed against the user's ear, with opening 17 for speaker 16A in housing 12 placed against the user's ear. As such part of the response characteristics of speaker 16A are shaped by the volume of air formed by front enclosure 70A or 70AA, aperture 504 and the interior volume 1200 of the user's ear. Notably, in one embodiment the interior volume 1200 is effectively not in communication with the volume of air that is in communication with the air around the distal end of port 510.

Figure 13:
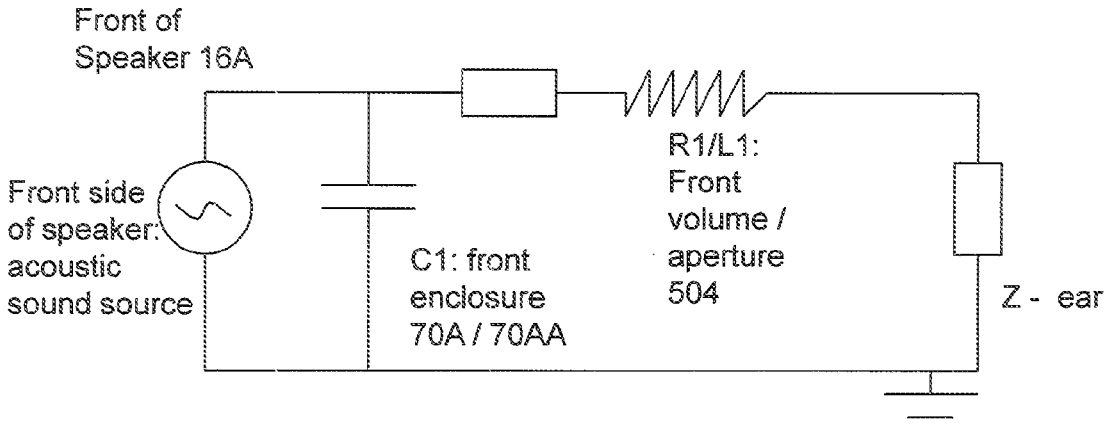
FIG. 13 is block diagram of an electrical circuit representing a model of an electrical circuit for the front speaker and the front enclosure of FIG. 4.

Referring to FIG. 13, block diagram 1300 shows an electrical circuit which provides an electrical circuit which provides a electrical circuit model of the acoustic properties of either of front enclosure 70A or 70AA and the front of speaker 16A. Therein the front side of speaker 16A is shown as a power source and is connected in parallel with the front volume provided by front enclosure 70A, shown as a capacitor. The front volume provided by the aperture 504 is modelled as a resistor/inductor element and is connected to the interior volume of the user's ear, which is modelled as an impedance element.

In other embodiments, an enclosure for a speaker may be provided on the same side of the PCB on which the speaker mounts, incorporating any one or more of the enclosure features, apertures or other acoustic properties described above.

As used herein, the wording "and/or" is intended to represent an inclusive-or. That is, "X and/or Y" is intended to mean X or Y or both.

In this disclosure, where a dimension is provided as an approximate value (for example, when the dimension is qualified with the word "about"), a range of values will be understood to be valid for that dimension. For example, for a dimension stated as an approximate value, a range of about 20% larger and 20% smaller than the stated value may be used. Dimensions of features are illustrative of embodiments and are not limiting unless noted.

It will be appreciated that descriptive terms like "first" and "second" are used to distinguish like elements apart from each other and such terms do not necessarily impart an order to the elements unless otherwise noted.

For the figures provided, cross-hatching of an element is not generally provided where a cross-section of the element is shown, in order to assist with clarity of same.

The present disclosure is defined by the claims appended hereto, with the foregoing description being merely illustrative of an embodiment of the present disclosure. Those of ordinary skill may envisage certain modifications to the foregoing embodiments which, although not explicitly discussed herein, do not depart from the scope of the present disclosure, as defined by the appended claims.

The invention claimed is:

1. A system providing a resonator for a transducer of an electronic device, comprising:

a housing defining a first enclosure having a first opening to house a back end of the transducer and a second opening;

a port connected to the first enclosure through the second opening of the first enclosure, the port having a first end, a second end, an interior channel and a second opening in the second end;

a second enclosure to cover a front portion of the transducer; and at least one aperture defined in the second enclosure to allow air outside of the electronic device to be in communication with the front of the transducer, wherein when the transducer is mounted into the first enclosure, a first volume between the transducer and the first enclosure is formed which is in communication with air surrounding the second end of the port through the interior channel of the port.

2. The system providing a resonator for a transducer of an electronic device as claimed in claim 1, wherein the housing further comprises:

an exterior wall; and an interior ledge connected to the exterior wall and defining the first opening, a top of the first enclosure and a bottom of the second enclosure.

3. The system providing a resonator for a transducer of an electronic device as claimed in claim 1, further comprising:

a cover for the electronic device to cover walls of the second enclosure, the port and the first enclosure, the cover having a second port mating with the port.

4. The system providing a resonator for a transducer of an electronic device as claimed in claim 3, wherein the cover:

covers a portion of an exterior wall of the transducer and a top of the second enclosure.

5. The system providing a resonator for a transducer of an electronic device as claimed in claim 3, wherein the cover further comprises:

a third opening in a top surface of the cover to allow the air outside of the electronic device to be in communication with a front of the transducer.

6. The system providing a resonator for a transducer of an electronic device as claimed in claim 1, wherein the housing further comprises:

a plurality of vertical walls defining parts of the first enclosure and second enclosure.

7. The system providing a resonator for a transducer of an electronic device as claimed in claim 6, wherein the housing further comprises:

a cap located on top of the plurality of vertical walls defining parts of second enclosure; and an aperture in the cap to allow the air outside of the electronic device to be in communication with a front of the transducer.

8. The system providing a resonator for a transducer of an electronic device as claimed in claim 1, further comprising:

a printed circuit board for the electronic device providing a mounting location for the transducer and forming a bottom of the first enclosure.

9. The system providing a resonator for a transducer of an electronic device as claimed in claim 8, further comprising:

a gasket located between the printed circuit board and a bottom edge of the first enclosure.

10. The system providing a resonator for a transducer of an electronic device as claimed in claim 1, wherein the transducer is a speaker.

11. The system providing a resonator for a transducer of an electronic device as claimed in claim 1, wherein the first enclosure is rectangular in shape.

12. The system providing a resonator for a transducer of an electronic device as claimed in claim 1, wherein the first enclosure has exterior dimensions of approximately 13 mm by 15mm by 4 mm.

13. The system providing a resonator for a transducer of an electronic device as claimed in claim 1, wherein the first enclosure has dimensions to provide the first volume to be approximately 0.2 $cm^3$ or less.

14. The system providing a resonator for a transducer of an electronic device as claimed in claim 1, wherein the resonator equalizes a frequency response of the transducer to be in a frequency range of between about 2 kHz and 3.5 kHz.

15. The system providing a resonator for a transducer of an electronic device as claimed in claim 1, wherein the port has a length of between approximately 1 mm and 10 mm.

16. The system providing a resonator for a transducer of an electronic device as claimed in claim 1, wherein the port has a cross-sectional area of between approximately 0.5 and $8mm^2$.

17. The system providing a resonator for a transducer of an electronic device as claimed in claim 1, wherein the second enclosure is rectangular in shape.

18. The system providing a resonator for a transducer of an electronic device as claimed in claim 1, further comprising acoustic mesh covering the second end of the port.

19. The system providing a resonator for a transducer of an electronic device as claimed in claim 1, wherein the housing is plastic.

* * * * *